United States Patent [19]

Wallin

[11] 3,958,496

[45] May 25, 1976

[54] CONTROL DEVICE FOR HYDRAULIC MACHINES

[75] Inventor: Bengt Johan Wallin, Vanersborg, Sweden

[73] Assignee: Volvo Flygmotor Aktiebolag, Trollhattan, Sweden

[22] Filed: Apr. 15, 1974

[21] Appl. No.: 461,203

[30] Foreign Application Priority Data

Apr. 25, 1973 Sweden ..... 7305829

[52] U.S. Cl. ..... 91/506; 417/222

[51] Int. Cl.[2] ..... F01B 3/00; F01B 13/04; F04B 49/00

[58] Field of Search ..... 417/218–222; 91/505, 506

[56] References Cited

UNITED STATES PATENTS

| | | | |
|---|---|---|---|
| 2,971,498 | 2/1961 | Bloch | 417/222 |
| 3,164,960 | 1/1965 | Weisenbach et al. | 417/222 |
| 3,407,738 | 10/1968 | Bosch | 417/218 |
| 3,554,671 | 1/1971 | Schlinke | 417/222 |
| 3,669,570 | 6/1972 | Himmler | 417/222 |

*Primary Examiner*—John J. Vrablik
*Attorney, Agent, or Firm*—Pollock, Vande Sande & Priddy

[57] ABSTRACT

A control device for hydraulic machines with variable displacement comprises a spring-biased control valve member for actuation of hydraulic adjustment means to provide the displacement variation, said valve member being engaged by one end of a double-armed lever on which acts a force proportional to the working pressure of the machine on an arm length relative to a pivot for said lever, which length is variable through a sliding movement of said pivot, and a means for controlling the maximum pressure of the machine. By a pressure means, the slidably movable pivot is resiliently biased against an indicating member responsive to the momentary adjusted displacement of the machine. Moreover, the control means for the maximum pressure of the machine consists of a stationary but adjustable abutment means adapted to restrict the length of the sliding movement of said pivot in order to determine a desired minimum value of said lever arm length and thus the value of the maximum pressure of the machine.

10 Claims, 2 Drawing Figures

CONTROL DEVICE FOR HYDRAULIC MACHINES

Figure 1:
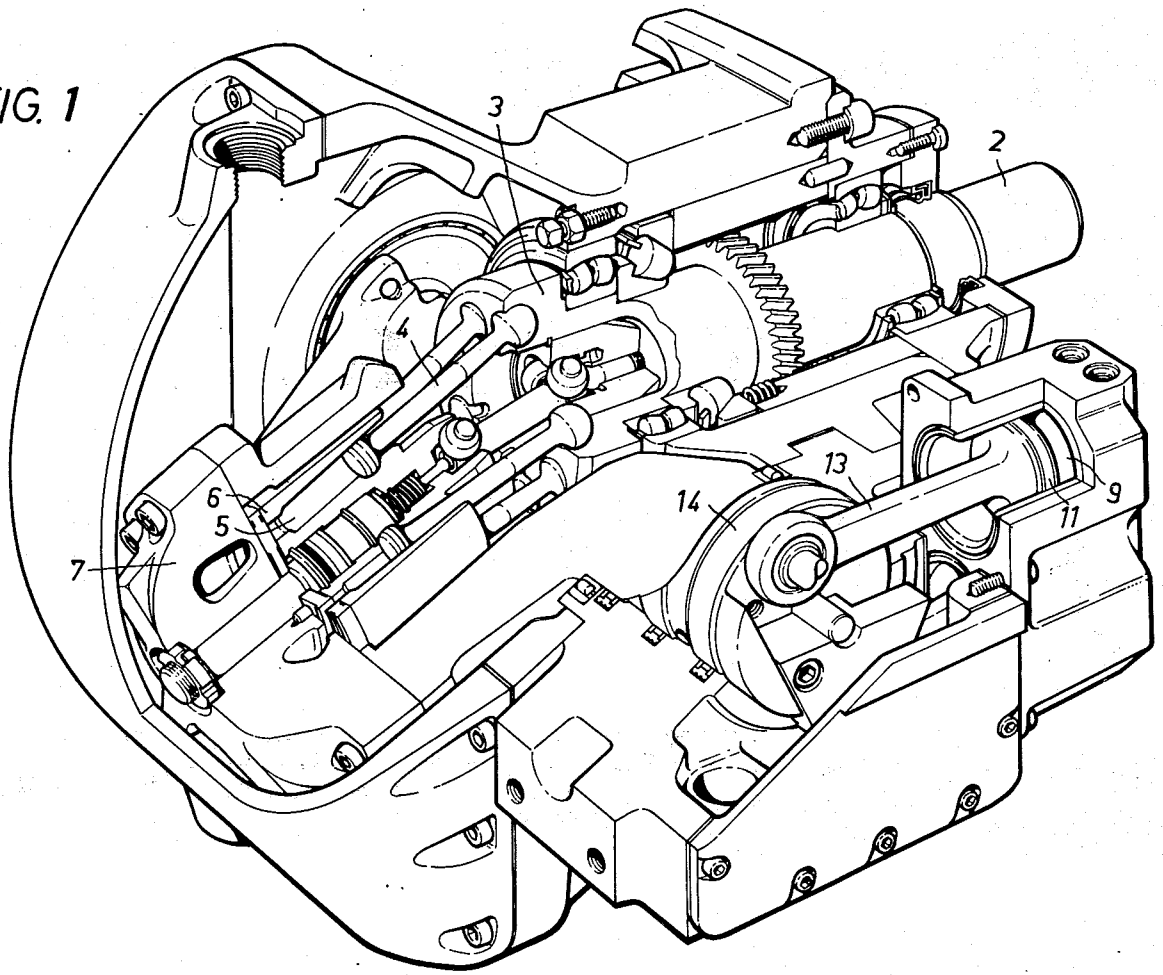

The present invention relates to a control device for hydraulic machines, particularly axial piston pumps, with variable displacement and comprises a spring-biased valve member adapted to control hydraulic adjustment means for variation of displacement. The valve is operatively engaged by one end of a double-armed lever, on the opposite end of which acts a force proportional to the working pressure of the machine at an arm length relative to a pivot for said lever, which length is variable through sliding movement of said pivot. A means is provided for controlling the maximum pressure of the machine necessary to pivot the double-armed lever to operate the spring-biased valve member.

Control devices of this kind are commonly used in hydraulic machines of various kinds. Such devices hitherto known have been single-acting in their structure, and, therefore, in variable hydraulic machines, in which a reversing of the flow also can occur, there is required a particular main flow reverse valve, which of course makes the whole device more expensive and complicated. For restricting the maximum pressure of the machine, several structural solutions can be chosen, either by using an over-flow valve in the main circuit, which converts energy into heat, which must be carried off, or by using a particular control valve actuating the hydraulic adjustment means for the displacement variation, which mostly tends to be more expensive than the first-mentioned measure.

As examples of a previously known control device which is similar to the present subject matter, reference is made to the German Offenlegungsschrift No. 1,653,385 and its addition, namely the German Offenlegungsschrift No. 1,906,983. The structures disclosed in both said publications suffer from the above-stated drawbacks.

The main object of the present invention is to provide an improved structure of a control device of the kind referred to above, in which the stated disadvantages have been effectively eliminated. The invention is based on the idea that, by simple mechanical design solutions, a drastically improved operation of the reliable structures previously known ought to be obtained. In accordance with the present invention, by a pressure means, the slidably movable pivot is resiliently biased against an indicating member responsive to the momentary adjusted displacement of the machine. The means for controlling the maximum pressure of the machine required to pivot the double-armed lever consists of a stationary but adjustable abutment means adapted to restrict the length of the sliding movement of said pivot in order to determine a desired minimum value of said lever arm length and thus the value of the maximum pressure of the machine required to pivot the double-armed lever.

By means of the invention, there is provided a control device which completely eliminates the necessity of an energy consuming over-flow valve for obtaining a restriction of the maximum pressure of the machine. This has been made possible by substituting, for the fixed connection between the adjustment means, the variation of the displacement adjustment and the slidably movable pivot in prior art structures a conditionally fixed connection; i.e., a connection under resilient bias by means of a pressure means. After stopping the pivot sliding movement against the abutment means, the control function thus will be dependent only on the pressure in the system fed by the pump.

A further significant advantage of the invention is that it forms the basis for a plurality of further structural measures which increase the utility of the machine in many applications and provides further advantages. Particularly, the structure of the control device and thus also the machine will be essentially simplified and therefore also made less expensive than previously known devices.

Figure 2:
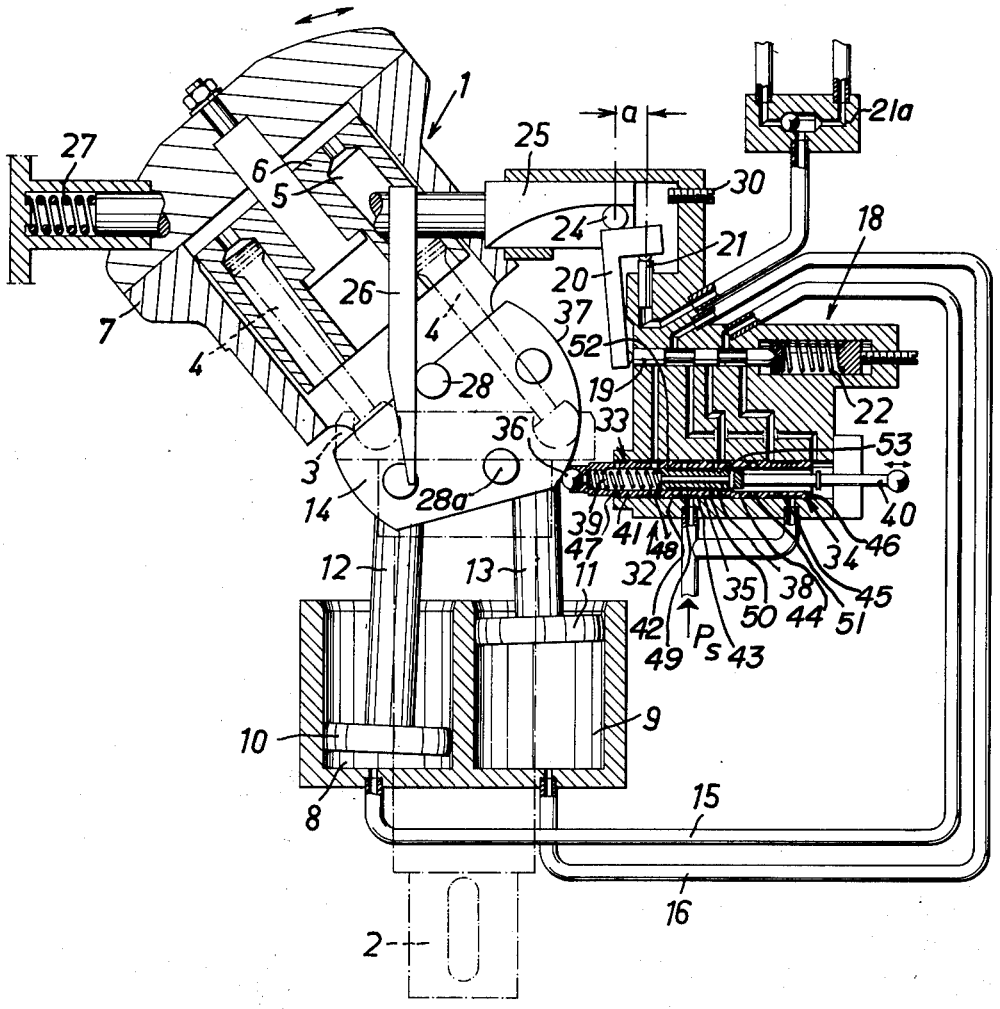

By way of example, the invention will be further described below with reference to the accompanying drawings, in which:

FIG. 1 is a perspective view of a hydraulic machine, partially broken away, in which machine the subject matter of the application is particularly suitable to use, and FIG. 2 is a partially sectioned side elevational view of such a hydraulic machine with associated control device according to the invention.

Although the present invention in its basic form in principle, as defined in the accompanying claims, can be applied in practically all existing hydraulic machines, it has its greatest advantage in axial piston machines and particularly axial piston pumps with variable displacement. Therefore, the invention will be described below applied to such an axial piston pump, more particularly of the type having a pivotally adjustable cylinder barrel support.

In the drawing, there is illustrated an axial piston pump 1 driven by a power source (not illustrated) through an input shaft 2. Said power source can be an internal combustion engine but may also comprise some other kind of suitable prime mover such as an electric motor, which thus can be reversible as to its direction of rotation. The shaft 2 carries a driving disc 3 which, as known per se, is provided with a plurality of bearing cups for accommodating the partially spherical bearing ends of a corresponding number of axial pistons 4, e.g. seven or nine pistons. Said pistons are slidably movable in corresponding cylinders 5 in a cylinder barrel 6 which is rotatably journalled in a support 7. To change the displacement of the pump 1, said support 7 is mounted pivotably to either side of a neutral position in alignment with the shaft 2. Said pivotal movement, which can amount to more than $\pm 40°$, is obtained by means of a pair of adjustment cylinders 8, 9 with associated pistons 10 and 11, respectively, having piston rods 12 and 13, respectively, pivotally connected with a crank disk 14. See FIG. 2.

The two cylinders 8 and 9 are connected to a control valve 18 with a spring-biased valve spool 19 through respective conduits 15, 16. The valve spool 19 is engaged at one of its ends by one end of a double-armed lever 20. The other end of lever 20 is engaged by a pressure means 21 with a force proportional to the operating pressure of the machine. As shown in FIG. 2, pressure means 21 comprises a piston which bears on one arm of lever 20. The piston moves in response to system pressure received from the hydraulic system via check valve 21*a*. The valve means 19 in the control valve 18 is kept biased as known by a spring 22. The force of said biasing spring 22 is also adjustable as known by means of a screw. Spool 19 comprises 3 spaced lands which permit flow from a servo valve 33 when spool 19 is in its neutral position (not shown) and from a reverse valve 34 when spool 19 is in its illustrated shifted position due to movement of lever 20 under the influence of system pressure on piston 21.

Although the lever 20 may be straight or of any other suitable configuration, it has been illustrated in the drawings as a bell-crank since this is advantageous from a design point of view. This bell-crank 20 is mounted pivotably about a pivot 24, which preferably can be constituted by a roller, rotatably journalled in a support member 25. Said support member is mounted slidably in a direction substantially parallel to one arm of the bell-crank while moving the pivot 24 along said arm. On said support member 25 is also mounted an arm 26 at right angles to the direction of sliding movement of said support member, and said arm 26 is adapted to be biased by means of a pressure means such as a biasing spring 27 into engagement with an indicating means 28, which is responsive to the momentary displacement adjustment of the machine. In the present case, the means 28 is formed as a crank pin secured to the crank disk 14 and parallel to the pivot axis of housing 7. Since the machine is of a variable type, in this case also a diametrically opposite crank pin 28*a* is mounted diametrically opposite pin 28 at an equal radius from the pivot axis of housing 7, said arm 26 having such a length that it can engage simultaneously both crank pins 28 and 28*a* in the neutral position of the axial piston pump.

As a result of said structural design, with a conditional connection instead of a fixed one between the pivot 24 and the adjustment means for the displacement variation, there is provided, according to the invention a restriction of the maximum pressure of the machine by a simple mechanical restriction of the length a of motion of the pivot 24, namely by means of a single set screw 30 in a bore in the housing of the control valve 18. For example, set screw 30 may be withdrawn to permit support 25 and roller 24 to come nearly into alignment with the axis of piston 21, in which case system pressure on piston 21 acts over a very short lever arm to pivot lever 20 and actuate valve 18 against the bias of spring 22. A high system pressure will thus be required to actuate valve 18. Conversely, set screw 30 may be turned inward to prevent support 25 and roller 24 from approaching alignment with the axis of piston 21, in which case pressure on piston 21 acts over a much longer lever arm. A much lower system pressure is required to actuate valve 18.

The conditional connection between arm 26 on support member 25 of pivot 24 and crank pin 28, turning about the same axis as the support 7, also provides the great advantage that the control function of the crank pin 28 on the pivot 24 will have a sinus-shape, which is advantageous in that the displacement of an axial piston pump of the present kind is proportional to the sine of the angle of adjustment of the support 7. Because of the presence of two diametrically opposite pins 28 on the disk 14, there is furthermore provided that the same control action will be achieved for a pivotal adjustment of the support 7 to either side of the neutral position, thus for both directions of flow.

The above-described structural design of the control device with the control valve 18 also is particularly well suited for combination with a servo valve 32 for selective adjustment of the displacement of the hydraulic machine. Although this servo valve can be of any suitable kind as known, it has been illustrated in the drawing as divided into a true servo valve portion 33 and a reverse valve portion 34. Servo valve portion 33 comprises a servo valve lining 35 slidably mounted in a valve bore. Lining 35 includes spaced lands 41, 42, 43, 44, 45 and 46 which slidably engage the valve bore and has a cam following end 36 protruding beyond said bore and engaging a cam surface 37 fixedly connected with a pivotable support 7, said cam surface in the present case being made directly on one side edge of the crank disk 14. Radial ports 47 communicate with the interior of lining 35 just outboard of land 41. Radial ports 48 are located between lands 41 and 42; ports 49, between lands 42 and 43; ports 50, between lands 43 and 44; and ports 51, between lands 44 and 45. When lining 35 is in its neutral position (not illustrated) inlet pressure is directed between lands 42 and 43 and 45 and 46. Inside the servo valve lining 35 is slidably mounted a valve body 38, having lands 52 and 53 spaced to close ports 48 and 50 when valve body 38 is in its neutral position. Body 38 is located between a biasing spring 39 and a manually adjustable control means 40 for setting the desired angle of pivotal motion and thus the pump displacement. The two portions 33 and 34 of the servo valve 32 are supplied with a suitable servo fluid of the pressure $P_s$ through suitable conduits, said servo pressure fluid being branched off from the main flow or emerging from a particular pressure fluid source. In response to the position of control means 40 servo pressure fluid is carried through suitable ports and passages of valve 32 to the control valve 18 to provide the desired servo effect. Although the reverse valve portion 34 of said servo valve 32 has been illustrated as controlled by the pivotal angle of the cylinder barrel support through the cam follower 36 and the cam surface 37, it is of course also possible to actuate the reverse valve in any other way, such as by means of pressure.

In operation, servo valve 33, reverse valve 34 and spool valve 19 cooperate in the following manner. When control means 40 is displaced toward the left as illustrated, pressurized fluid passes through port 49, around valve body 38, out port 48, between the left hand lands of spool 19 and out through conduit 16 to raise the piston 11 in cylinder 9. Return flow from cylinder 8 passes through conduit 15, between the right hand lands of spool 19, through port 50 to the interior of valve body 38 and returns to the fluid supply. As cam surface 37 rotates, spring 39 causes lining 35 to shift to the left, thereby closing ports 48 and 50 with lands 52 and 53 and holding the pivotable support 7 in the desired position. When control means 40 is moved to the right, a similar set of flow paths is established to raise piston 10 and lower piston 11, as will be appreciated by those skilled in the art.

Suppose that at some point in the previously described sequence the pressure in the system reaches a sufficient level to pivot lever 20 and shift spool 19 to its illustrated position. Communication between servo valve 33 and conduits 15 and 16 is then blocked by the left hand lands of spool 19; however, communication is established in reverse flow direction between reverse valve 34 and conduits 15 and 16 to swing pivotable support 7 in the opposite direction and decrease pump displacement, until the system pressure drops sufficiently to allow spool 19 to return to its neutral position. Thus, a high system pressure actually causes the pump displacement to be decreased until an acceptable pressure level is reached, after which pump displacement will again be raised to the level dictated by the position of control means 40.

As is evident from the foregoing the invention can be used in all kinds of hydraulic machines but its advantages are most obvious when applied in connection with axial piston machines of both the so-called bent-axis type, as in the above-described embodiment, and of the in-line type. In spite of the fact that only one single valve is used, namely the control valve 18, the invention still allows an individual adjustment of both the maximum pressure to actuate control valve 18 and maximum power level. Furthermore, the device according to the invention can be used not only as a pressure restriction device in two directions of flow but also as a combined power and pressure restricting device in two directions of flow as well as a power and pressure control device in one direction of flow. The combined restricting function of the power and pressure thereby is obtained by combination of the control valve 18 and the servo valve 32 as described above.

I claim:

1. A control device for use in a variable displacement hydraulic machine of the type including hydraulically actuated means for varying said displacement, comprising:

a member movable by said hydraulically actuated means in response to changes in said displacement;

movable pivot means resiliently biased to contact said movable member for movement in response thereto;

resiliently biased valve means for controlling fluid flow to said hydraulically actuated means;

means mounted for movement in said machine in response to the working pressure thereof;

lever means slidably contacting said movable pivot means and adapted for pivotal motion thereabout, said lever means being pivoted in response to forces received from said spring biased valve means and said pressure responsive means, whereby said lever means pivots about said pivot means to actuate said spring biased valve means in response to movement of said pressure responsive means due to said working pressure; and adjustable means for restricting movement of said pivot means along said lever means to vary the effective lever arms for said valve means and said pressure responsive means.

2. A control device according to claim 1, further comprising a reversing valve actuated by said hydraulically actuated means for interchanging the high and low pressure sides of said resiliently biased valve means to reverse the movement of said hydraulically actuated means when said resiliently biased valve means is actuated.

3. A control device according to claim 1, wherein said adjustable means comprises a set screw mounted in said machine in a position to limit movement of said pivot means.

4. A control device according to claim 3, further comprising a reversing valve actuated by said pivotable cylinder barrel support for interchanging the high and low pressure sides of said resilient biased valve means to reverse the movement of said hydraulically actuated means when said resiliently biased valve means is actuated.

5. A control device according to claim 1, wherein said machine is an axial piston machine with a pivotable cylinder barrel support operatively connected to said hydraulically actuated means; said movable member being mounted on said barrel support at a point spaced from the pivot axis of said cylinder barrel support; and said pivot means comprising a support member having a pivot thereon and an arm extending at right angles thereto, said support member being resiliently biased whereby said arm contacts said movable member to provide a sine curve shaped relation between the position of said pivot and the position of said cylinder barrel support as said cylinder barrel support is pivoted by said hydraulically actuated means.

6. A control device according to claim 5, wherein said adjustable means comprises a set screw mounted in said machine in a position to limit movement of said pivot means.

7. A control device according to claim 5, further comprising a reversing valve actuated by said pivotable cylinder barrel support for interchanging the high and low pressure sides of said resiliently biased valve means to reverse the movement of said hydraulically actuated means when said resiliently biased valve means is actuated.

8. A control device according to claim 5, wherein said movable member comprises a pair of pins mounted on said barrel support at diametrically opposite locations and at equal radii from said pivot axis; and said arm is a sufficient length to contact both said pins when said barrel support is in its neutral position.

9. A control device according to claim 8, wherein said adjustable means comprises a set screw mounted in said machine in a position to limit movement of said pivot means.

10. A control device according to claim 8, further comprising a reversing valve actuated by said pivotable cylinder barrel support for interchanging the high and low pressure sides of said resiliently biased valve means to reverse the movement of said hydraulically actuated means when said resiliently biased valve means is actuated.

* * * * *